US006070388A

United States Patent [19]

Zerlin et al.

[11] Patent Number: 6,070,388

[45] Date of Patent: Jun. 6, 2000

[54] BAG OPENING SYSTEM

[75] Inventors: Elizabeth Zerlin; Richard Ackerman, both of Roslyn; Stewart Senator, East Patchogue, all of N.Y.

[73] Assignee: Eezzer Corp., Roslyn, N.Y.

[21] Appl. No.: 09/243,963

[22] Filed: Feb. 3, 1999

[51] Int. Cl.[7] ..... B65B 43/38

[52] U.S. Cl. ..... 53/384.1; 53/390; 186/66

[58] Field of Search ..... 53/384.1, 385.1, 53/386.1, 390; 186/66

[56] References Cited

U.S. PATENT DOCUMENTS

| | | | |
|---|---|---|---|
| 2,899,161 | 8/1959 | Bayard . | |
| 3,025,651 | 3/1962 | Stanley . | |
| 3,431,704 | 3/1969 | Smedlund | 53/384.1 |
| 3,646,723 | 3/1972 | Meroney . | |
| 4,798,041 | 1/1989 | Bentsen | 53/384.1 |
| 4,821,985 | 4/1989 | Dematteis et al. . | |
| 5,125,604 | 6/1992 | Vrooman et al. . | |
| 5,183,158 | 2/1993 | Boyd et al. . | |
| 5,287,971 | 2/1994 | Dorman . | |
| 5,303,889 | 4/1994 | Malik et al. . | |
| 5,642,791 | 7/1997 | Zerlin et al. . | |
| 5,687,545 | 11/1997 | Baker | 53/384.1 |
| 5,862,653 | 1/1999 | Solano | 53/384.1 |
| 5,966,900 | 3/1969 | Burford et al. | 53/384.1 |

*Primary Examiner*—Eugene L. Kim
*Attorney, Agent, or Firm*—Collard & Roe, P.C.

[57] ABSTRACT

A device for opening a series of bags in a stack. The device comprises a rotatable element having a substantially circular cross section. This element rotates and grabs a front side of the bag. Attached to the rotatable element is a first drive mechanism for rotating the element. In addition, a sensor is attached to the first drive mechanism. The sensor reads when the rotatable wheel grabs the bag. A second drive mechanism is connected to the first drive mechanism. This second drive mechanism drives the wheel into and back away from the bag stack. In this way, when the rotatable element rotates and moves into the bag, it grabs the bag. Next, it wraps the bag around the element so that the bag trips the sensor. The sensor triggers the motor to stop the element from rotating. In addition, the sensor signals the second drive mechanism to move the element away from the bag stack, to open the bag.

14 Claims, 7 Drawing Sheets

BAG OPENING SYSTEM

BACKGROUND OF THE INVENTION

1. Field of the Invention

The present invention relates to a bag opening system that has a rotatable element designed to open bags in a stack. The rotatable element moves into the bags, grabs a front end of a bag and then moves away from the bag stack to open the bag.

2. The Prior Art

Bag opening systems are known in the prior art. For example, U.S. Pat. No. 5,642,791 to Zerlin et al discloses a plastic bag packing system that is used with a retail store check out counter. This plastic bag packing system has an electrically powered motor and a retractable arm assembly.

In addition U.S. Pat. No. 5,303,889 to Malik et al. discloses a wire holder for plastic bags, while U.S. Pat. No. 5,183,158 to Boyd et al. discloses a bag dispensing system having a bag pack. Furthermore, U.S. Pat. No. 5,125,604 to Vrooman discloses a system for automatic consecutive opening and dispensing thermoplastic grocery or retail product bags.

Dispensing racks for plastic bags are also known in the art for example, U.S. Pat. No. 5,287,971 to Dorman discloses a rack for supporting a loaded plastic bag while U.S. Pat. No. 4,821,985 to De Matteis et al. discloses a rack for plastic T-shirt grocery bags. Finally, in an analogous field, U.S. Pat. No. 3,646,723 to Maroney discloses a system for filling a flexible sealable container.

SUMMARY OF THE INVENTION

The invention relates to a device for opening a series of bags in a stack. The device comprises a rotatable element having a substantially circular cross section. When the rotating element hits the front of a bag, it grabs the bag via friction and pulls it around the element. To drive this rotating element, a first drive mechanism attaches to the rotating element to rotate the rotatable element around. In addition, attached to the first drive mechanism is a sensor having a sensor clip. This sensor is for reading when the rotatable element has captured the bag. The rotatable element grabs the bag and holds it in place, while the sensor signals the first drive mechanism to stop rotating the rotating element.

A second drive mechanism is connected to the first drive mechanism. This second drive mechanism is for driving the wheel into and back away from the bag stack. The second drive mechanism is also connected to a position sensor. The position sensor sends out a signal so that at a certain position, the rotation of the second drive mechanism stops and the first drive mechanism grabs the bag. Next, the bag trips the sensor. The sensor signals the second drive mechanism to move the element away from the bag stack, to open the bag. In a preferred embodiment of the invention, the rotatable element is a rubber wheel. In a second embodiment of the invention, the rotatable element is a cylindrical shaft.

The first drive mechanism comprises a 12 volt reversible DC motor and an axle. The motor spins the axle around a horizontal axis in both a forward and backward direction depending on the polarity of the voltage to the motor. The second drive mechanism connects to the first drive mechanism via a U-shaped connecting bracket. The second drive mechanism comprises a 12 volt reversible DC motor, an axle, and at least one arm. The arm has a first end connected substantially perpendicular to the axle and a second end connected substantially perpendicular to the connecting bracket. Thus, when the motor rotates, it turns the axle, which consequently swings the arm around a vertical axis. Rotation about this vertical axis causes the connecting bracket and the rotating element to move into and away from the bag stack.

The second drive mechanism preferably contains two arms spaced parallel to each other. To keep these two arms spaced apart from each other, there is a joint block disposed between the two arms at the first end of each arm, and an opposite connecting block on the second end of each arm.

To keep these arms from rotating too far, the bag opening system also contains a rotation sensor for detecting the rotation of a drive shaft on the second motor. Thus, when the shaft has rotated up to its predetermined distance, a cam attached to the shaft hits the sensor which relays a signal to the motor to stop rotation. With this design, the arms will rotate into and away from the bags within a set radial length.

It is an object of the present invention to provide an efficient, reliable bag opening system that opens bags in a stack.

It is another object of the invention to provide a bag opening system that is simple in design, inexpensive to manufacture and easy to install.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
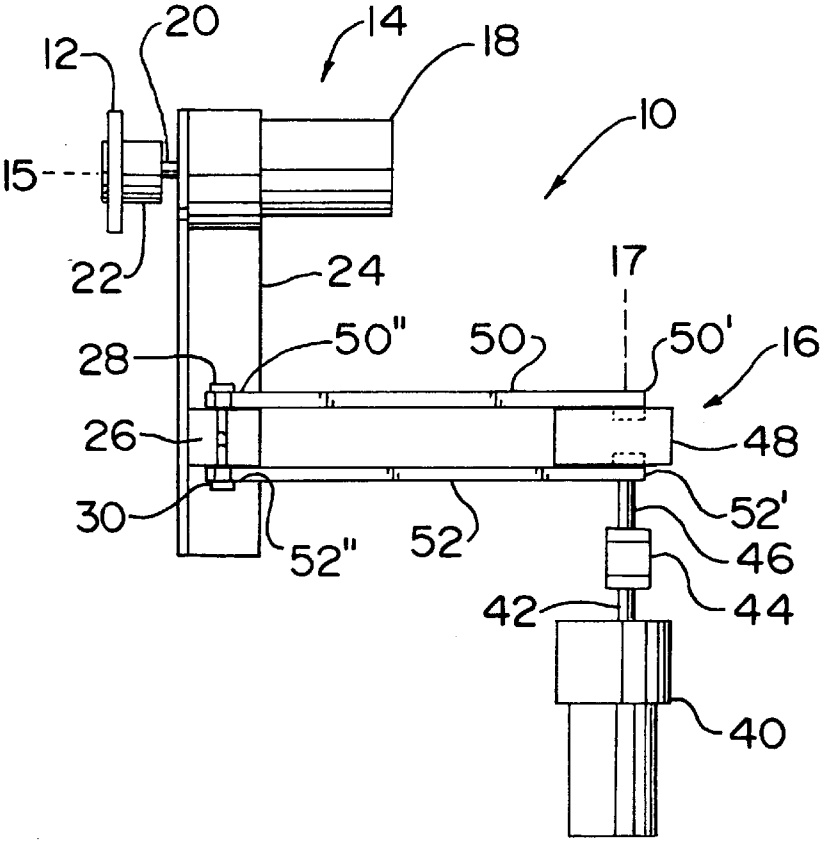
FIG. 1 shows a side view of the bag opening system.

In the drawings, FIG. 1 shows a side view of the bag opening system 10. Bag opening system 10 comprises a rotatable wheel 12, a first drive mechanism 14 for rotating wheel 12 about a horizontal axis 15, and a second drive mechanism 16 for driving rotatable wheel 12 about a vertical axis 17 into and away from a stack of bags.

Figure 4:
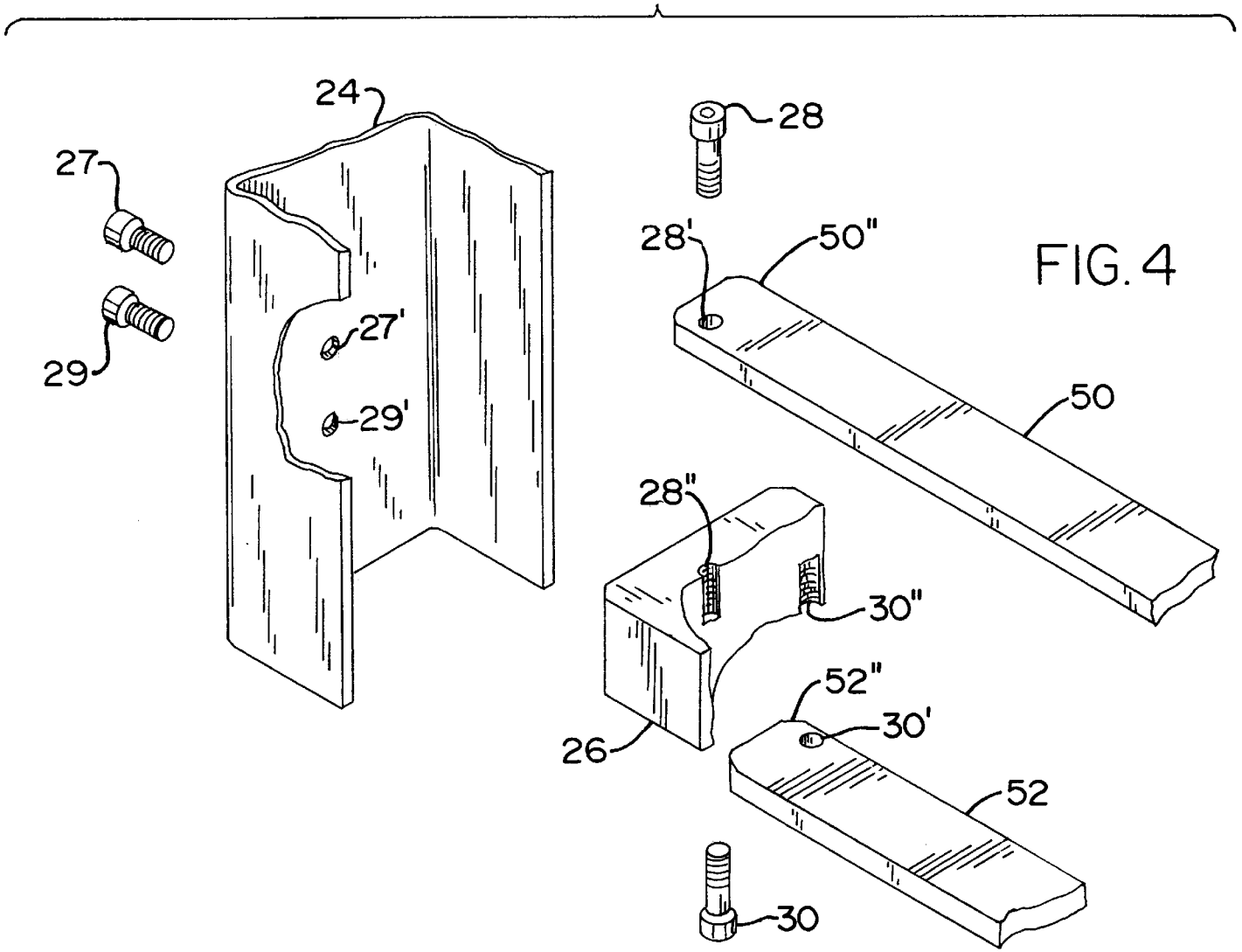
FIG. 4 shows an exploded view of the parallel arms connecting to the connecting bracket.

The first drive mechanism 14 contains a 12 volt reversible DC motor 18 and an axle 20. This drive mechanism 14 connects to wheel base 22 which supports wheel 12. Drive mechanism 14 also connects to U-shaped connecting bracket 24. Connecting bracket 24 connects to connecting block 26 via top bolt 27 and bottom bolt 29. (FIG. 4). Connecting block 26 connects to arms 50 and 52 on second drive mechanism 16 via top bolt 28 and bottom bolt or shaft 30.

Second drive mechanism 16 comprises a 12 V reversible DC motor 40, that rotates an upward extending axle 42. Axle 42 connects to a linkage 44 which extends up to shaft 46. Shaft 46 rotates in joint block 48 which keeps parallel extending arms 50 and 52 spaced parallel apart from each other. Parallel extending arms each have a corresponding first end 50' and 52' and a corresponding second end 50" and 52". Essentially, second drive mechanism 16 drives arm 52 about a first vertical axis 17, while arm 52 pulls arm 50 about a second vertical axis 17'.

Figure 2:
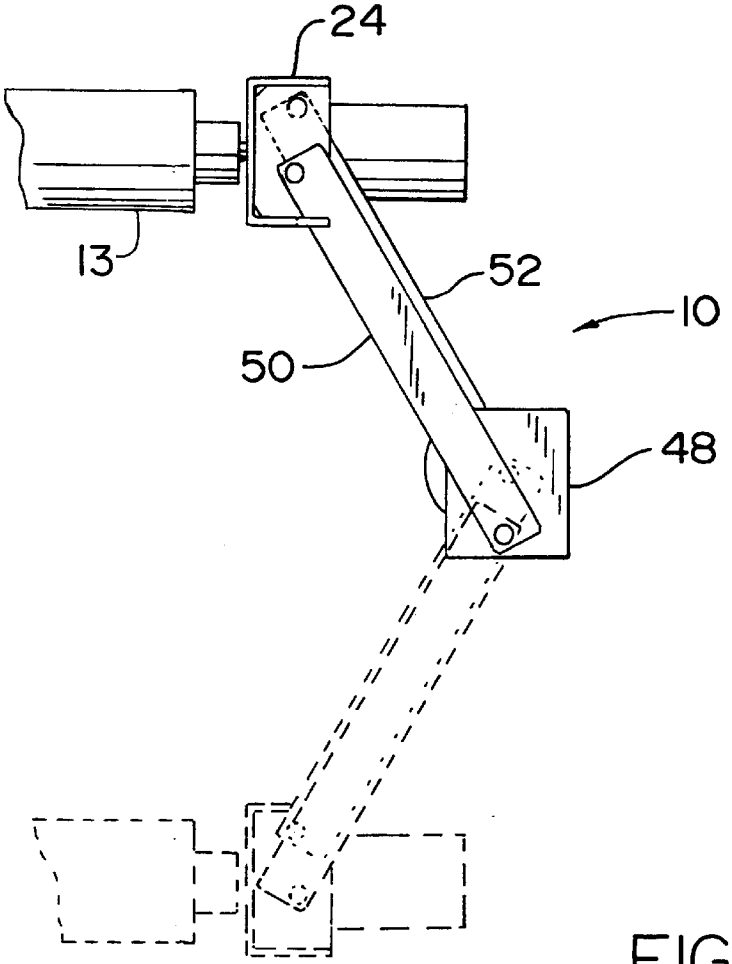
FIG. 2 shows a top view of the bag opening system.

FIG. 2 shows a second embodiment of bag opener 10, wherein rotatable wheel 12 is replaced by a rotatable shaft 13. Rotatable shaft 13 is moved into and away from a bag stack. Motor 40 rotates parallel arms 50 and 52 so that rotating wheel 12 remains aligned substantially perpendicular to a bag face throughout its rotation. This feature is particularly important because if wheel 12 strikes a front end of a bag in an offset way, it may not properly grab the bag and open it. Therefore, this design contains parallel offset arms to keep wheel 12 perpendicular to a bag face.

Figure 3:
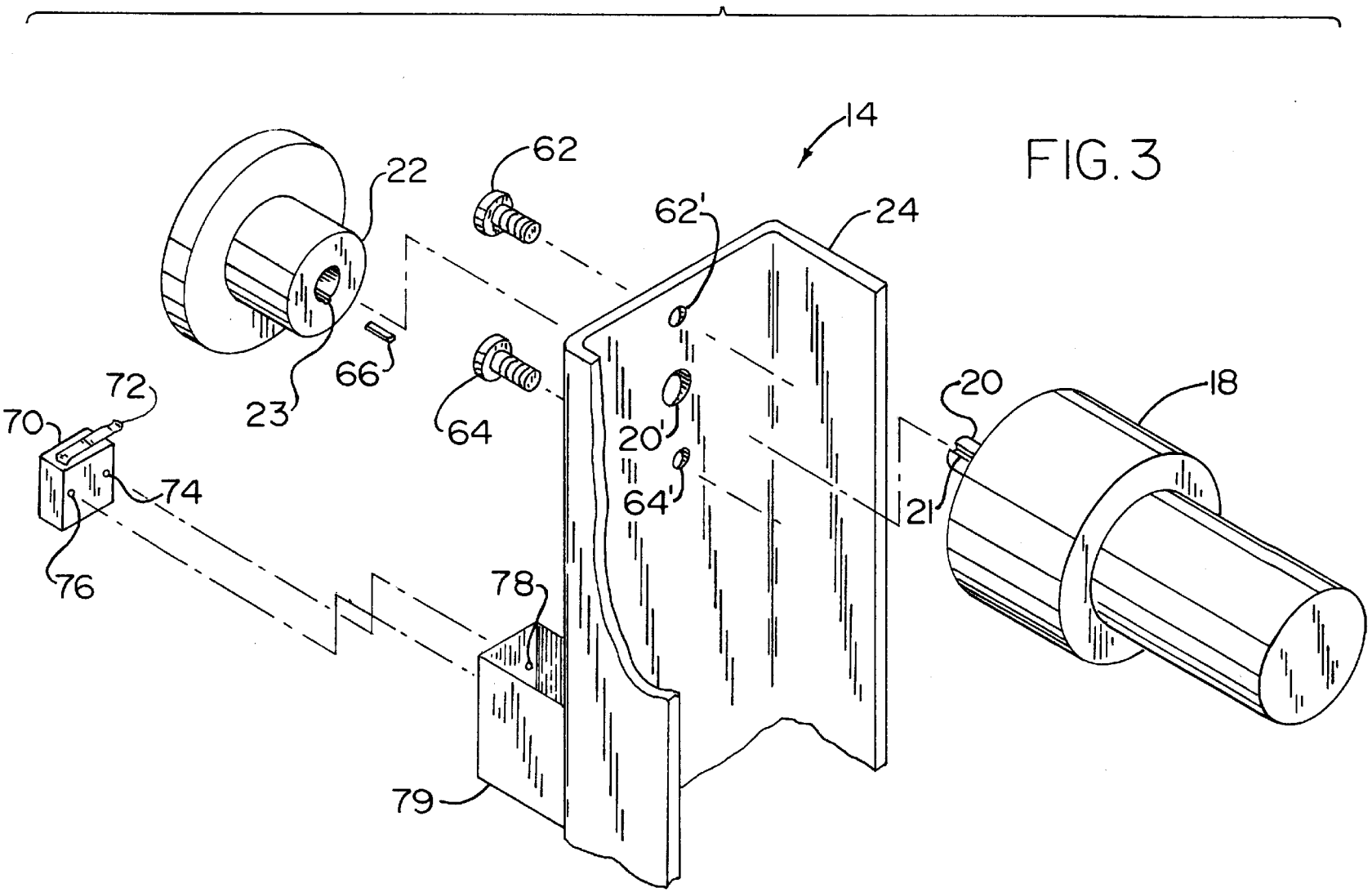
FIG. 3 shows an exploded view of the first drive mechanism.

FIG. 3 shows an exploded view of first drive mechanism 14. First drive mechanism 14 comprises a motor gear box assembly 18 and an axle 20. Motor gear box assembly 18 connects to U-shaped connecting member 24 via screws 62 and 64 fitting through screw holes 62' and 64' on connecting bracket 24. In addition axle 20 fits through axle hole 20' on connecting bracket 24 so that axle 20 inserts into wheel base 22. Axle 20 is rotatably fixed inside wheel base 22 via pin 66 which secures axially inside notch 21 on axle 20 and notch 23 in wheel base 22. A sensor 70 attaches to connecting bracket 24 via a U-shaped plate 79. Sensor 70 is positioned behind wheel 12 and has a sensor clip 72 designed to receive a bag being pulled around rotating wheel 12. Sensor 70 has holes 74 and 76 which are adapted to receive screws that fit through hole 78 on plate 79.

FIG. 4 shows an exploded view of a connection between arms 50 and 52, connecting to connecting bracket 24. In this case, parallel extending arms 50 and 52 connect to connecting block 26 at their respective second ends 50" and 52". Bolt 28 secures arm 50 to connecting block 26 through hole 28' on arm 50 and hole 28" on connecting block 26. In addition, bolt 30 secures arm 52 to connecting block 26 through hole 30' on arm 30 and hole 30" on connecting block 26. Bolts 28 and 30 allow rotation of arms 50 and 52 respectively. In addition, bolts 27 and 29 insert through corresponding holes 27' and 29' on U-shaped connecting bracket 24 to connecting block 26. To keep rotatable wheel 12 aligned perpendicular to a bag face, arms 50 and 52 are rotatably attached to connecting bracket 24 through block 28. Thus as arms 50 and 52 rotate about their respective axes 17 and 17', (FIG. 1) this causes block 26 to pivot, keeping wheel 12 aligned perpendicular to a bag face.

Figure 5A:
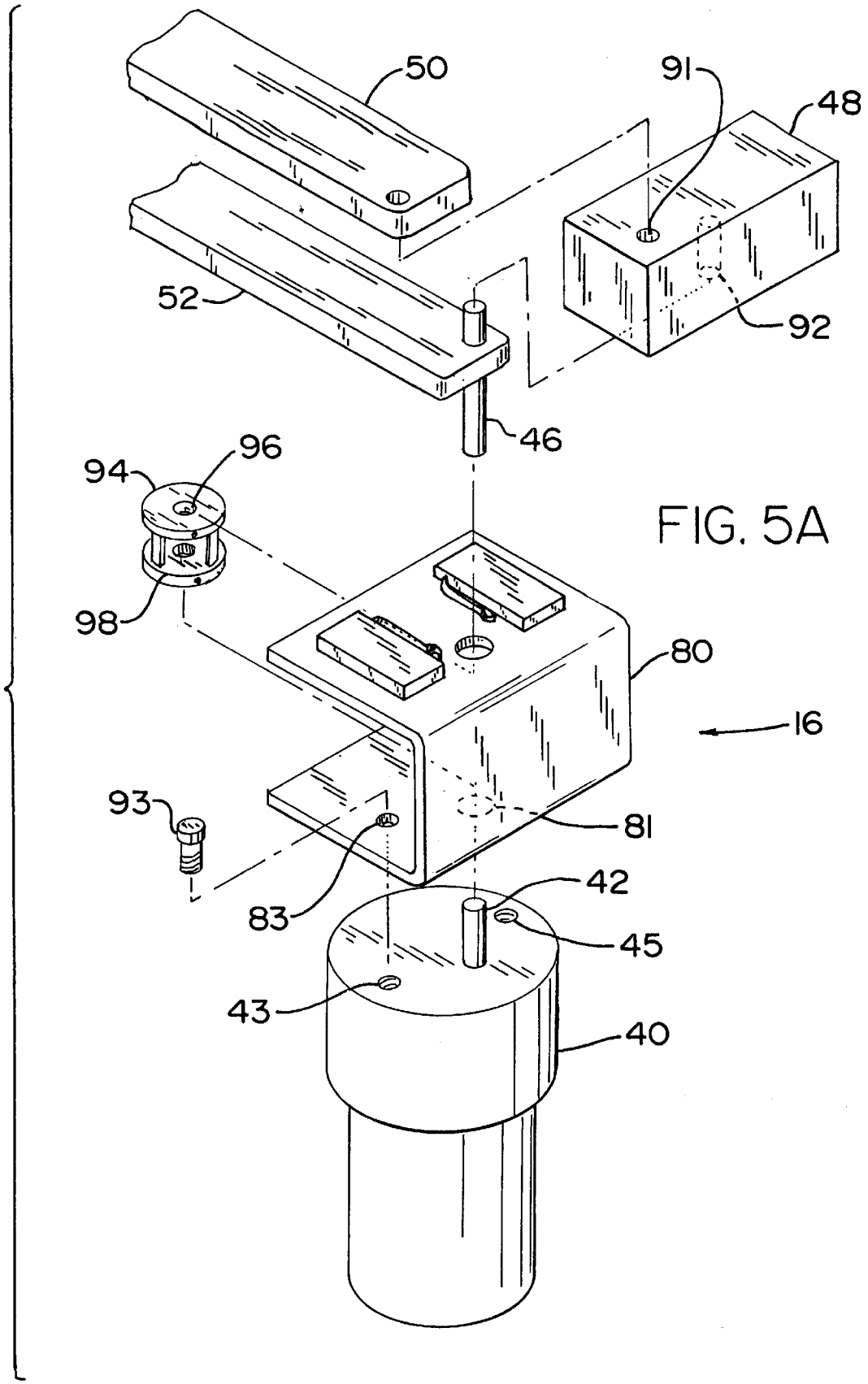
FIG. 5A shows an exploded view of the second drive mechanism.

FIG. 5A shows an exploded view of second drive mechanism 16. Second drive mechanism 16 comprises a reversible motor 40 and axle 42 that insert through hole 81 on U shaped bracket 80. Bracket 80 fixes to motor 40 through screw 93 which inserts through hole 83 on bracket 80 and hole 43 on motor 40. Hole 45 on motor 40 is shown, and hole 45 will also accept a screw through bracket 80. U-shaped bracket 80 receives joint block 48 in its top face. Joint block 48 contains pin holes 91 and 92 wherein pin hole 91 receives screw 100 while pin hole 92 receives bar 48. Holes 91 and 92 are offset from each other so that when arms 50 and 52 rotate, rotatable wheel 12 does not change its angle of orientation in relation to a bag stack. Thus, rotatable wheel 12 keeps its perpendicular orientation throughout the rotation of the second drive mechanism.

Bar 46 connects to joint block 48, extending through arm 52 and extends through U-shaped bracket 80 and into cylindrical connector 94. Cylindrical connector 94 has a top hole 96 and a bottom hole 98 wherein top hole 96 receives bar 46 while bottom hole 98 receives axle 42. Thus, cylindrical connector 94 axially connects motor 40 with arms 50 and 52.

Figure 5B:
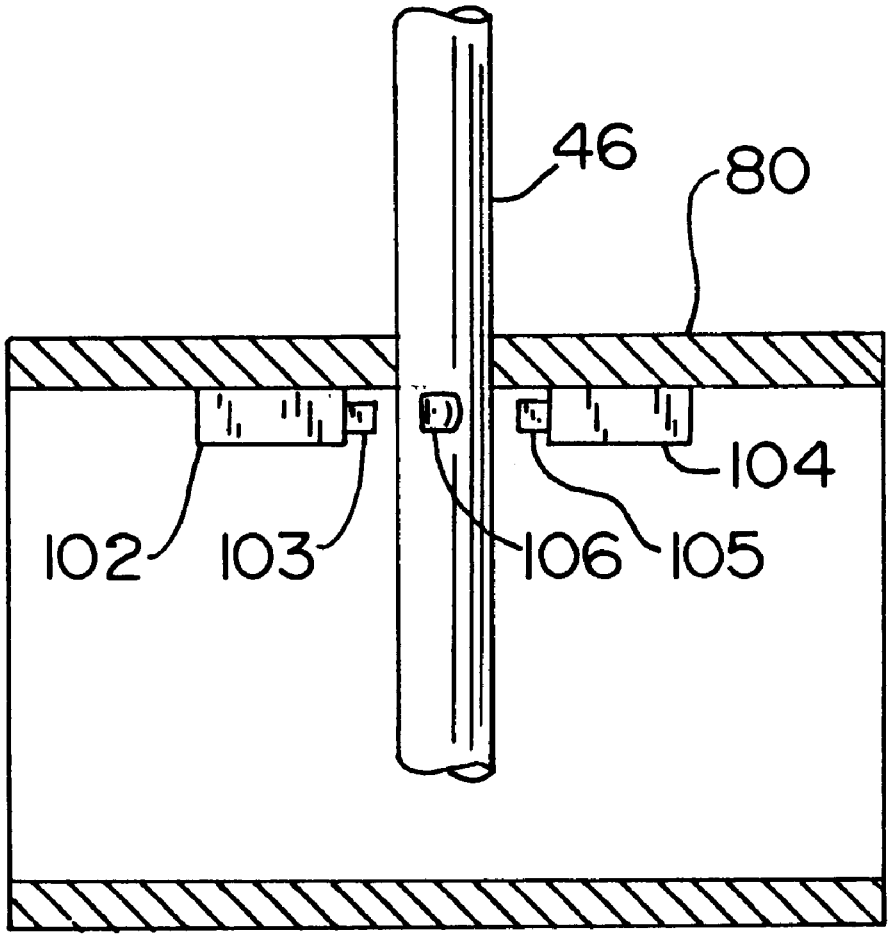
FIG. 5B shows a front end view of a bracket and sensor of the second drive mechanism.

FIG. 5B shows a front end view of the bracket 80. Blocks 102 and 104 connect to a bottom surface of a top shelf of bracket 80. Connected to blocks 102 and 104 are sensors 103 and 105 respectively. Sensors 103 and 105 are used to detect when shaft 46 has rotated too far and should therefore rotate back. For example when shaft 46 rotates too far forward, cam 106 hits sensor 103 on block 102. In addition when shaft 46 rotates too far back, cam 106 hits sensor 105 causing shaft 46 to stop rotating.

Figure 6:
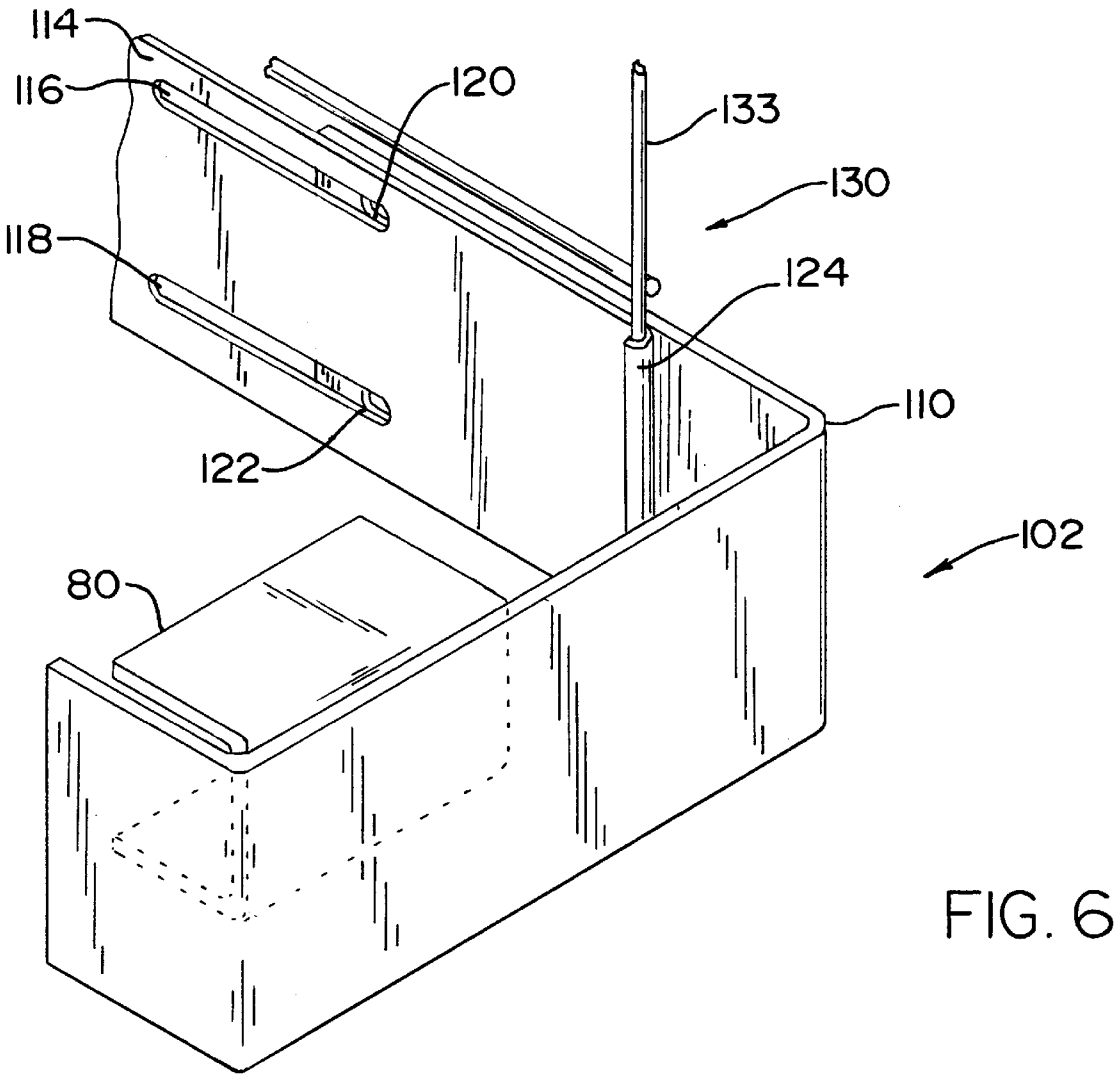
FIG. 6 shows a base bracket attaching to a wire frame for holding bags.
Figure 7:
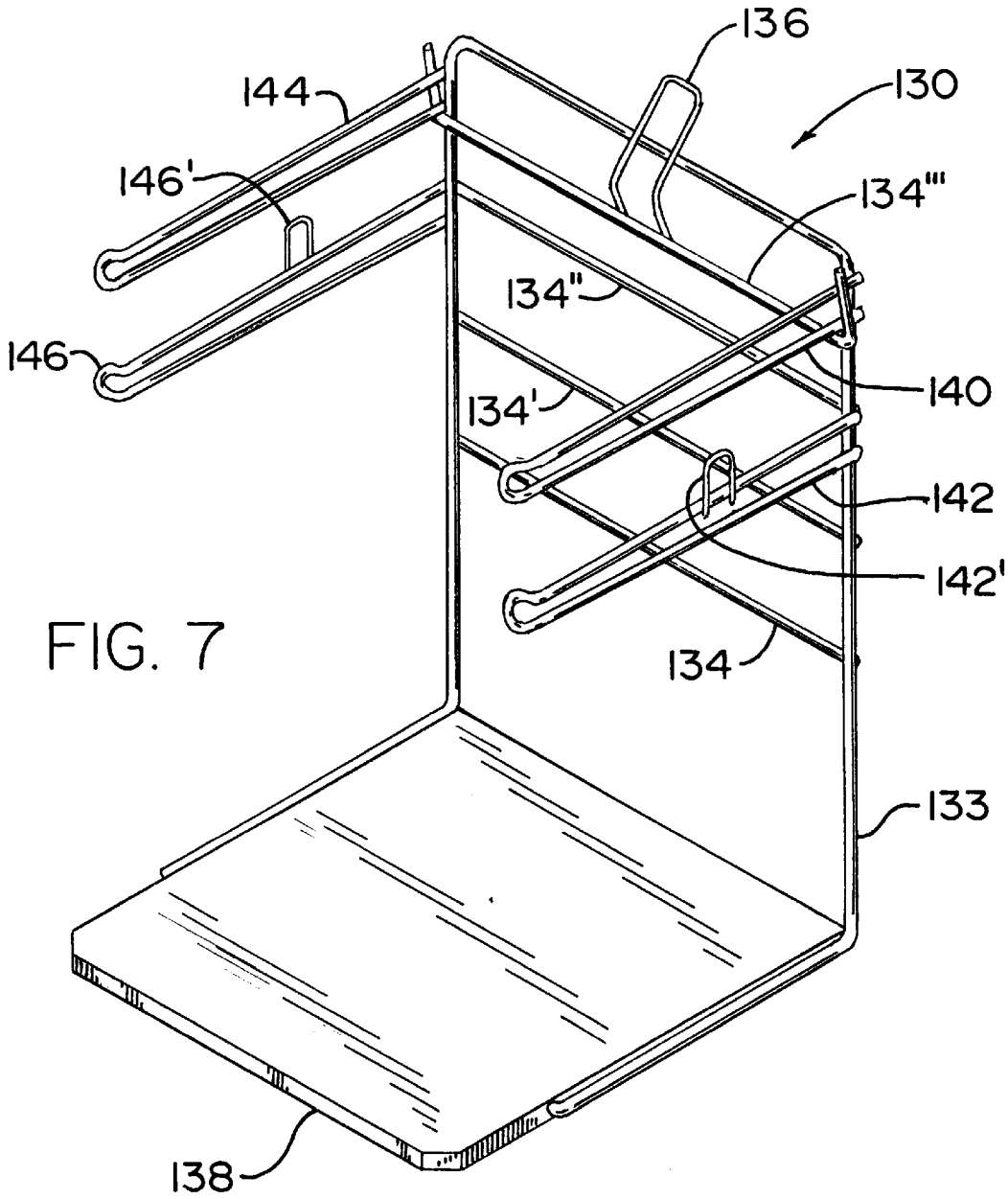
FIG. 7 shows a perspective view of a wire frame for holding bags.

FIG. 6 shows a perspective view of base 102 that connects to a wire frame 130 (FIG. 7). Base 102 has a base bracket 110 which has holes 120 and 122. Attached to base bracket 110 is second bracket 114 having slots 116 and 118. Slots 116 and 118 extend to holes 120 and 122. Bracket 116 extends to a curl 124 that curls around vertical wire 133. In addition, attached to bracket 110 is U-shaped bracket 80 which supports motor 40 and arms 50 and 52 (not shown) and block 48.

FIG. 7 shows wire bag holder 130 having vertical wires 132 and 133 connected to each other by a series of horizontal wires 134. Extending out from vertical wires are wire beams 140, 142, 144 and 146. Beams 142 and 146 each have a corresponding U-shaped ridge 142' and 146' to catch plastic bags as they extend out on beams 142 and 146. A U-shaped catch 136 is disposed on horizontal wire 134". U-shaped catch is designed to secure a flat stack of T-shirt bags to wire bag holder 130. Wire frame 130 secures to a stationary block 138 so that frame 130 is supported upright.

When the bag opening system 10 opens a bag, a front end of a bag is caught by rotating wheel 12, (FIG. 1) so that it tears away from U-shaped catch 136. The bag then rotates around wheel 12 and hits sensor clip 72. Sensor clip 72 holds the bag in place and signals motor 18 to stop rotating wheel 12. Next, motor 40 reverses its rotation so that arms 50 and 52 rotate back away from frame 130. This reverse rotation pulls a front end of a bag away from frame 130. A top end of the bags slide across beams 140 and 144 to open the bag. Once the bag has been filled, it can then be torn away from the frame.

Accordingly, while a few embodiments of the present invention have been shown and described, it is to be understood that many changes and modifications may be made thereunto without departing from the spirit and scope of the invention as defined in the appended claims.

What is claimed is:

1. A device for opening a series of bags in a stack comprising:

a rotatable element having a substantially circular cross section, said element adapted to grab a portion of the bag;

a first drive mechanism attached to said rotatable element for rotating said element;

a sensor attached to said first drive mechanism, said sensor reading when said rotatable element grabs the bag;

a second drive mechanism connected to said first drive mechanism said second drive mechanism driving said element into and back away from the bag stack, wherein when said rotatable element rotates and moves into the bag, said element grabs the bag, wraps the bag around the element and trips said sensor, wherein tripping the sensor stops said element from rotating and signals said second drive mechanism to move said element away from the bag stack, to open the bag.

2. The device as claimed in claim 1, wherein said rotatable element is a wheel.

3. The device as claimed in claim 2, wherein said wheel is made from rubber.

4. The device as claimed in claim 1, wherein said first drive mechanism connects to said second drive mechanism via a connecting bracket.

5. The device as claimed in claim 1, wherein said first drive mechanism comprises a motor, and an axle wherein said axle connects to said rotatable element and said motor rotates said rotatable element.

6. The device as claimed in claim 5, wherein said motor is a 12 volt DC reversible motor.

7. The device as claimed in claim 4, wherein said second drive mechanism comprises a motor, an axle extending out from said motor, and at least one arm having a first end connected substantially perpendicular to said axle and a second end connected substantially perpendicular to said connecting bracket, so rotating the turns said axle, and turns said at least one arm, driving said connecting bracket and said rotating element into and away from the stack of bags.

8. The device as claimed in claim 7, wherein said second drive mechanism motor is a 12 volt DC reversible motor.

9. The device as claimed in claim 7, wherein said second drive mechanism further comprises at least a second arm spaced parallel to said at least one arm, wherein said motor rotates said axle and drives said substantially parallel arms into and back away from said stack of bags.

10. The device as claimed in claim 1, wherein said sensor further comprises a sensor clip, and wherein when said bag hits said sensor clip said sensor clip grabs the bag and signals said first drive mechanism to stop said rotatable element from rotating.

11. The device as claimed in claim 9, further comprising a joint block and a connecting block, said joint block connecting said arms to each other at said first end of said arms and said connecting block connecting said arms to each other at said second end of said arms.

12. The device as claimed in claim 4, wherein said connecting bracket is elongated and U-shaped.

13. The device as claimed in claim 1, further comprising at least one rotation sensor connected to said second drive mechanism for detecting when said second drive mechanism rotates a predetermined distance.

14. The device as claimed in claim 1, wherein said rotatable element is an elongated shaft.

* * * * *